United States Patent [19]

Dudley et al.

[11] 4,030,308

[45] June 21, 1977

[54] MINE ROOF SUPPORTS

[75] Inventors: Philip Dudley; Lewis Robert Bower; Malcolm Wake, all of Wakefield, England

[73] Assignee: Fletcher Sutcliffe Wild Limited, England

[22] Filed: May 21, 1976

[21] Appl. No.: 688,939

[52] U.S. Cl. ..... 61/45 D; 248/357

[51] Int. Cl.[2] ..... E21D 15/44

[58] Field of Search ..... 61/45 D; 299/31–33; 248/357; 91/170 MP

[56] References Cited

UNITED STATES PATENTS

| | | | |
|---|---|---|---|
| 3,269,686 | 8/1966 | Allen | 61/45 D X |
| 3,309,054 | 3/1967 | Davis-Ratcliffe | 61/45 D X |
| 3,531,162 | 9/1970 | Ashurst | 61/45 D X |
| 3,646,768 | 3/1972 | Whitaker | 61/45 D |
| 3,832,856 | 9/1974 | Sigott et al. | 248/357 |

*Primary Examiner*—Dennis L. Taylor
*Attorney, Agent, or Firm*—Lowe, King, Price & Markva

[57] ABSTRACT

A mine roof support comprises at least one pair of hydraulically extensible chock legs connected at upper ends in articulated manner between one or more roof beams of the support and connected at lower end in articulated manner to one or more base members of the support, a rigid yoke located at a position spaced from the base member(s) between and connecting either the pair of chock legs, the yoke containing between the chock legs a projecting pin secured in a bearing attached to the yoke, or one of the pairs of chock legs, the yoke containing two projecting pins each pin being secured in a bearing attached to the yoke, and the or each pin having a lateral base contained at one side between abutment surfaces secured to the base member(s) and at the other to one end of a load applying means, the other end of the load applying means being supported from the base member(s).

26 Claims, 7 Drawing Figures

MINE ROOF SUPPORTS

This invention relates to mine roof supports of the type incorporating a plurality of hydraulically extensible chock legs connected between one or more roof beams and one or more base members of the support.

Supports of the above type are commonly used in the longwall mining of minerals by being spaced along the mineral face with an armoured face conveyor interposed between the supports and the face. Each support is connected to individual sections of the conveyor, by one or more double-acting hydraulic advancing rams, so that with the chock legs pressurised the advancing ram(s) may be extended to push its conveyor section towards the newly exposed mineral face after passage of a mineral cutting machine, and conversely when it is required thereafter to advance the support to the conveyor, the chock legs are brought into retracted condition and the advancing ram(s) is retracted so that the support pulls itself forward from the conveyor.

In practice however, firstly there is relative movement between the mine roof and the mine floor and secondly should the roof bar(s) of the support strike a projection from the roof whilst advancing, both of which situations have the effect that if the chock legs are assumed initially to be set vertically, their upper ends (and hence the roof bar(s) carried hereby) are displaced away from the mineral face by a few degrees. To avoid damage by bending or distortion to roof supports due to this strata movement several constructions have been proposed not only to provide accommodation for a few degrees displacement e.g. up to 5°, but also to return the chock legs to their required position after being so displaced and after release from the roof. Thus the ends of the chock legs have been articulated to their base members, and roof beams, for example by being formed as ball and socket joints, while a miscellany of means have been proposed for restoring the chock leg. Such proposals have included for instance springs both of the coil and leaf type, small rams, inflatable formers under hydraulic or pneumatic control, and rubber blocks.

According to the present invention, a mine roof support comprises at least one pair of hydraulically extensible chock legs connected at upper ends in articulated manner between one or more roof beams of the support and connected at lower ends in articulated manner to one or more base members of the support, a rigid yoke located at a position spaced from the base member(s) between and connecting either the pair of chock legs, the yoke containing between the chock legs a projecting pin secured in a bearing attached to the yoke, or one of the pairs of chock legs, the yoke containing two projecting pins each pin being secured in a bearing attached to the yoke, and the or each pin having a lateral base contained at one side between abutment surfaces secured to the base member(s) and at the other to one end of a load applying means, the other end of the load applying means being supported from the base member(s).

Thus, in practice, under the influence of the load applying means, the lateral base of the or each pin is urged by the unit into contact with the abutment surfaces, and upon movement of the chock legs, for one reason or another, from their pre-determined position, this movement is transferred by the yoke through its bearing(s) to the pin or at least to one of the two pins and hence to the lateral base(s) thereof, and hence to the load applying means, the loading and/or resistance to displacement of which means react against this movement. Of course, there is a maximum amount of movement possible dictated by the articulated connections of the chock legs at the roof bar(s) and the base member(s). However, provided the displacement is within this design limit, upon release of the chock legs from the roof, the load applying means is arranged to be sufficient to restore the chock legs to their predetermined position by acting on the pin(s) via the lateral base(s) and hence through the yoke bearing(s) and the yoke.

Thus, with a four-leg roof support and a first yoke connecting the pair of forward legs and a second yoke the pair of rearward legs, the location of the pins between the respective pairs of forward and rearward legs ensures that the way between the forward and rearward legs is not obstructed. With the two pin construction, this is particularly suitable for instance for a thin seam four or five leg support where the pins apply restoring forces to their associated pair of legs, which forces are transmitted from these legs to the other legs via the common roof beam(s). Thus the yoke may connect a pair of rearward legs.

The load applying means of the or each pin may be constituted by a permanently pressurised hydraulic piston and cylinder unit, a permanently pressurised gas unit e.g. of nitrogen, a spring or a rubber block, or a combination of any of these elements.

Basically, each pin and lateral base member may be arranged for compressive or tensile loading by the load applying means.

Thus, with the compressive arrangement (and considering the load applying means as a piston and cylinder unit for example), the or each lateral base may be seated on one piston and cylinder unit, and preferably on the piston thereof, to be urged upwardly into engagement with the abutment surfaces, the longitudinal axis of the pin and its piston and cylinder unit being coincidental, while in the tensile arrangement, the or each base may include a pivot pin to which the piston of the piston and cylinder unit is attached by a flexible member, e.g. a wire rope and, with pressurisation of the piston and cylinder unit urging the piston away from its pin, the rope is tensioned to pull the lateral base into engagement with the abutment surfaces, the longitudinal axis of each pin and its piston and cylinder unit again being coincidental. The gas unit would work similarly as would the rubber e.g. bonded to steel end plates, and the spring.

With the compressive arrangement a slide plate and a pad of low friction material are interposed between the or each lateral base and its piston and cylinder unit. Also with this arrangement, and for example the load applying means constituted by a piston and cylinder unit, the latter may seat on a base plate spanning a pair of laterally spaced base members. An annular wear block may be carried within the end of the cylinder to bear on the piston periphery, to resist any tendency for the piston and cylinder becoming mis-aligned when the latter is loaded by the lateral base of each pin.

Preferably, the lateral base of the or each pin is circular and terminates in an annular rib having arcuate bearing surfaces for contact with the abutment surfaces and with an outer surface of the load applying means e.g. the base of the cylinder, or the projecting end of the piston, while the abutment surfaces preferably include complementary, part annular recesses. When the chock legs are displaced, one or both the lateral bases react between a part of a recess and a diametrically opposite part of the load applying means.

With the tensile arrangement, an extension piece load applying means e.g. extending from the cylinder of the or each piston and cylinder unit, may seat on the opposite side of the abutment surface to which the lateral base is pulled, which surface may be provided by a plate having a central aperture for passage of the wire rope. A shaft may extend from load applying means, e.g. the piston and pass through a closed end of the cylinder to project therefrom, for attachment thereto e.g. on a pin, of the other end of the wire rope, with the annulus side of the piston pressurised. When the chock legs are displaced, the lateral base or one of the two lateral bases pivot(s) at one side about a portion of the abutment surfaces, the diametrically opposite sides being lifted therefrom.

The yoke preferably takes the form of a plate having spaced apart semi-circular surfaces or holes of diameter corresponding to the external diameter of the chock legs, one surface or hole to engage the external periphery of each chock leg. For the two pin construction the yoke may be provided with an extension e.g. rearwardly, to locate a portion of the yoke over the load applying means.

Whilst the preferred arrangement is for each load applying means to be constituted by a pre-loading hydraulic piston and cylinder unit, either the compressive or the tensile arrangement may additionally incorporate a spring, operative in the direction of pre-loading, of a rating sufficient to restore the chock legs to the initial position upon release of the support from the roof, should hydraulic failure or leakage affect the functioning of the hydraulic pre-loading. Such a spring may be located either within each piston and cylinder unit, or externally thereof.

The position of the or each pin with respect to its yoke may be varied by mounting the bearing via a multi-position block to give the effect of eccentric positioning of the bearing(s) and hence the pin(s). Such eccentric positioning may be employed to give the legs a pre-set angle of inclination, which is of advantage e.g. when working in inclined mineral seams or in poor roof conditions. In detail, the or each bearing may be mounted in a square block locatable in a square recess in the yoke and indexable between four different positions. Also the or each recess may be off-centre with respect to the yoke so that turning the yoke through 180° in its plane of connection to the legs provides even further possibilities for adjustment of the pin(s) position.

Conveniently the hydraulic pre-loading of a piston and cylinder unit is effected by a feed line tapping into the conventional mains pressure service line to the chock legs. A separate return line from the piston and cylinder unit can be avoided if the feed line is provided with a one way check valve by-passed by a relief valve.

Thus in accordance with another feature of the present invention, the unit is provided with an inlet-exhaust conduit by which hydraulic fluid is firstly admitted to the cylinder to extend the piston therefrom the conduit being provided with a check valve and the check valve being bypassed by a relief valve comprising a poppet valve member guided for displacement along its longitudinal axis, the poppet valve member having a valve head normally urged, under the action of a compression spring, into engagement with a valve seat of a circular port, and a spindle connecting the valve head to a valve end slidable in a bore of diameter equal to that of the port, on which valve end bears the spring, through which relief valve hydraulic fluid may be exhausted from the piston and cylinder unit into the conduit.

The invention will now be described in greater detail, by way of examples, with reference to the accompanying drawings, in which:

FIG. 1 shows diagrammatically a portion of a first embodiment of mine roof support in accordance with the invention;

FIG. 2 corresponds to FIG. 1 but shows a second embodiment;

In the various embodiments shown in the drawings, like numerals are used for like components.

Figure 1:
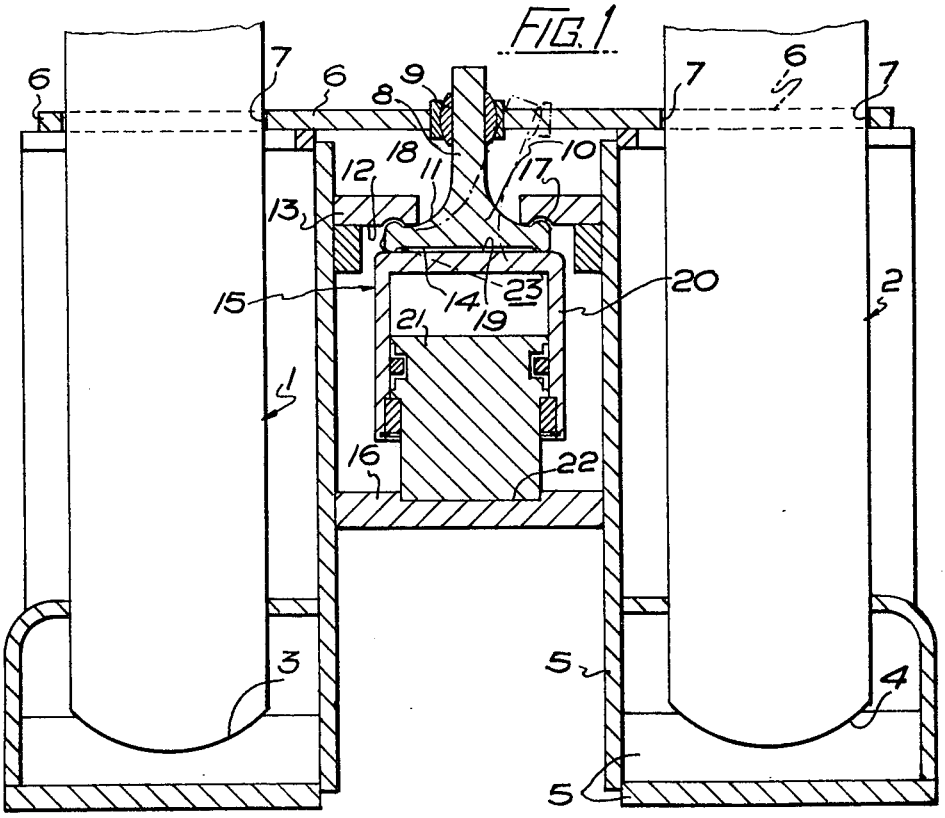

In the embodiment of FIG. 1 is shown the lower portion of a mine roof support incorporating a pair of adjacent chock legs 1,2, each supported on respective arcuate surfaced lower ends 3,4, in articulated manner, to base members 5 of the support, upper ends (not shown) of the legs 1,2, being also secured in known articulated manner to one or more roof beams of the support.

A rigid yoke 6 is spaced upwardly from the base members 5 and takes the form of a plate provided with two circular holes 7 corresponding to the diameter of the chock legs 1,2, so as to connect together the legs 1 and 2. Between the latter, the yoke 6 is provided with a projecting pin 8 secured in a bearing 9 attached to the yoke and provided with arcuate bearing surfaces. The pin 8 has a circular lateral base 10 contained at one side 11 between lower surfaces 12 of abutment members 13 secured to the base members 5, and at the other side 14 to a load applying means 15 mounted on a base plate 16 spanning the base members 5. The lateral base 10 terminates in an annular rib having an arcuate bearing surface 17 to engage a complementary annular recess 18 in the lower surface 12.

The load applying means 15 comprises a permanently pressurised hydraulic piston and cylinder unit, the side 14 of the lateral base 10 seating on an outer surface 19 of cylinder 20, while piston 21 seats in a recess 22 in the base plate 16, hydraulic pressure fluid being admitted to chamber 23.

In FIG. 1 the roof support is shown with the load applying means 15 fully extended to maintain the whole of the lateral base 10 in engagement with the surfaces 13 and 19, in which position the pin 8 has, by displacing the yoke 6 through the bearing 9, brought the legs 1,2 into a predetermined position. In use, and upon relative movement between the mine roof and floor, the legs 1,2 are allowed to move from the predetermined position — which may be vertical or which may for example be a 3° forward inclination — about the arcuate surfaces of the lower ends 3,4, the yoke 6 sliding for example to the left or to the right of FIG. 1, until a maximum allowable movement is reached when the external periphery of the chock legs strikes support structure of the base members, e.g. after 7° of movement, in which position it is also arranged for the chamber 23 to be closed, so that surface 19 attains position 19A shown in chain-dotted line and the pin 8 is displaced to position 8A shown in chain-dotted line with, as shown in FIG. 1, the left hand part of the lateral base maintaining engagement with the left hand surface 12 and the right hand part of the lateral base maintaining engagement with a right hand part of the surface 19. If, in use, the chock legs 1,2 become displaced from the predetermined position then upon release from the roof the permanent pressurisation of the chamber 23 urges the pin 8 into the position shown in the full line in FIG. 1 and hence displaces the yoke 6 to restore the legs 1,2 to their predetermined position.

Figure 2:
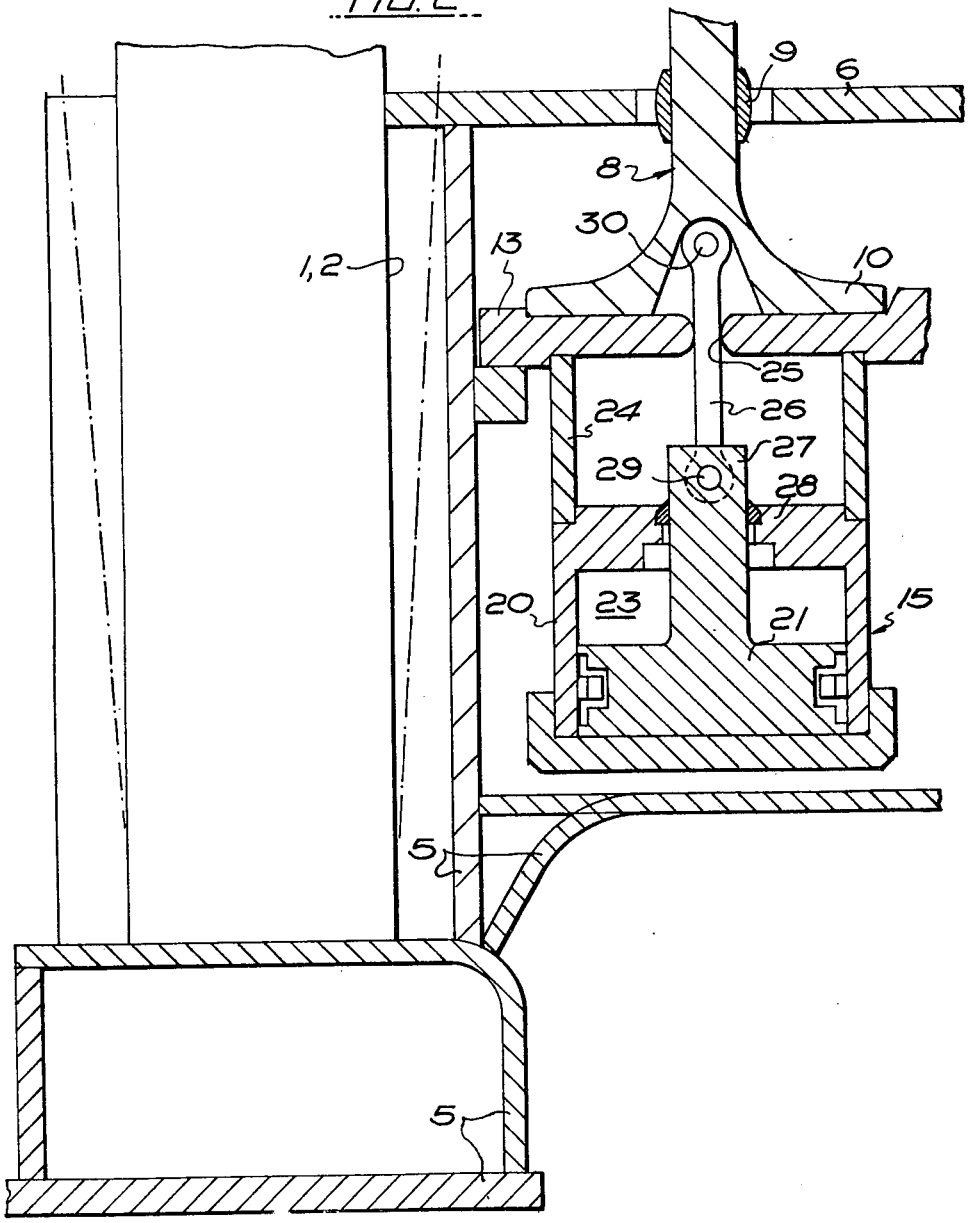

In the embodiment of FIG. 2, the pin 8 is acted upon by tensile forces in contrast to FIG. 1 where compressive forces are employed to achieve leg restoration.

However, the load applying means 15 is reversed so that the cylinder 20 seats on abutment member 13 via an extension piece 24. The abutment member 13 is provided by a plate having a central aperture 25 for the passage of a flexible member in the form of a wire rope 26, a shaft 27 extending from the piston 21 and passing through closed end 28 of the cylinder 20 to project from the latter. The rope is attached to the shaft 27 on a pin 29 and is attached to a portion of the lateral base 10 on a pin 30.

Figure 3:
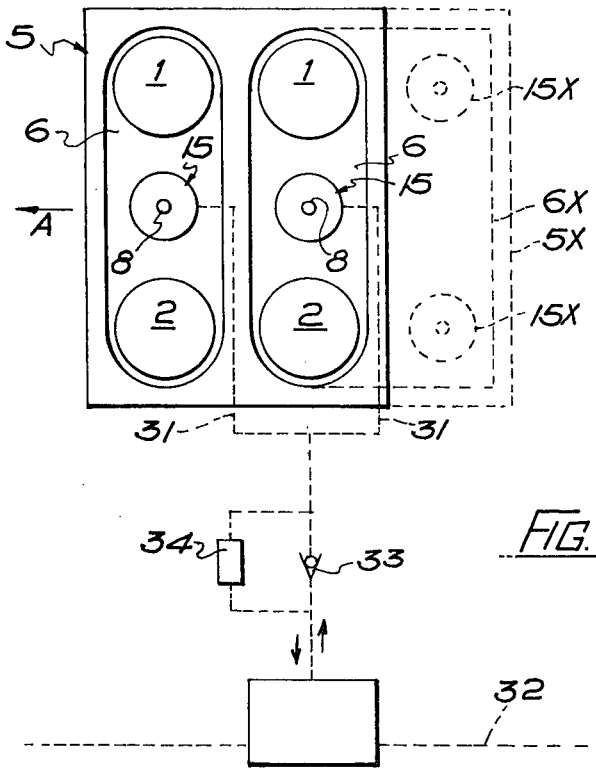
FIG. 3 is a diagrammatic plan view of a 4 leg support incorporating leg restoration units in accordance with FIG. 1 or FIG. 2.
Figure 4:
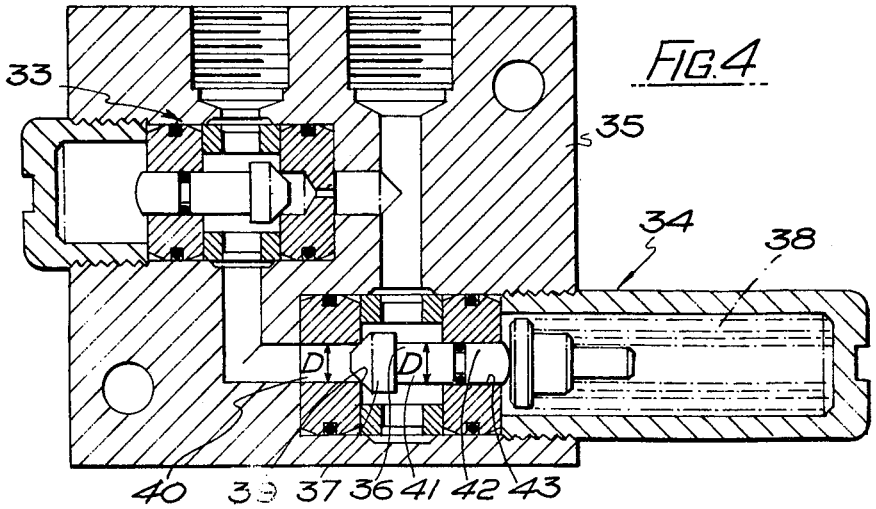
FIG. 4 is a sectional view through a valve block containing the valves of FIG. 3.

In FIG. 3 is indicated diagrammatically a four-leg roof support comprising a pair of forward legs 1,2 and a pair of rearward legs 1,2, each connected by a yoke 6 provided with one load applying means 15, and each means 15 is provided with an inlet/exhaust conduit 31 to admit or exhaust hydraulic fluid from the chambers 23, the conduit 31 being connected to a mains pressure line 32. The conduit 31 is provided with a check valve 33 by which fluid is admitted to the chambers 23 and a relief valve 34 is by-passing the check valve 33 by which relief valve fluid may be exhausted from the chambers 23. As shown in detail in FIG. 4, the valves 33 and 34 are contained in a valve block 35 and the relief valve 34 is provided with a poppet valve member 36 having a valve head 37 normally urged under the action of a compression spring 38 into engagement with a valve seat 39 of a port 40 having a diameter D, a spindle 41 connecting the valve head 37 to a valve end 42 slidable in a bore 43 also on diameter D. In use, the relief valve 34 is not effected by back pressure resulting from closure of the chambers 23 due to displacing forces on the chock legs 1,2, while the rating of the spring 38 is determined to pre-set the pressure at which it is required the relief valve to open.

Figure 5:
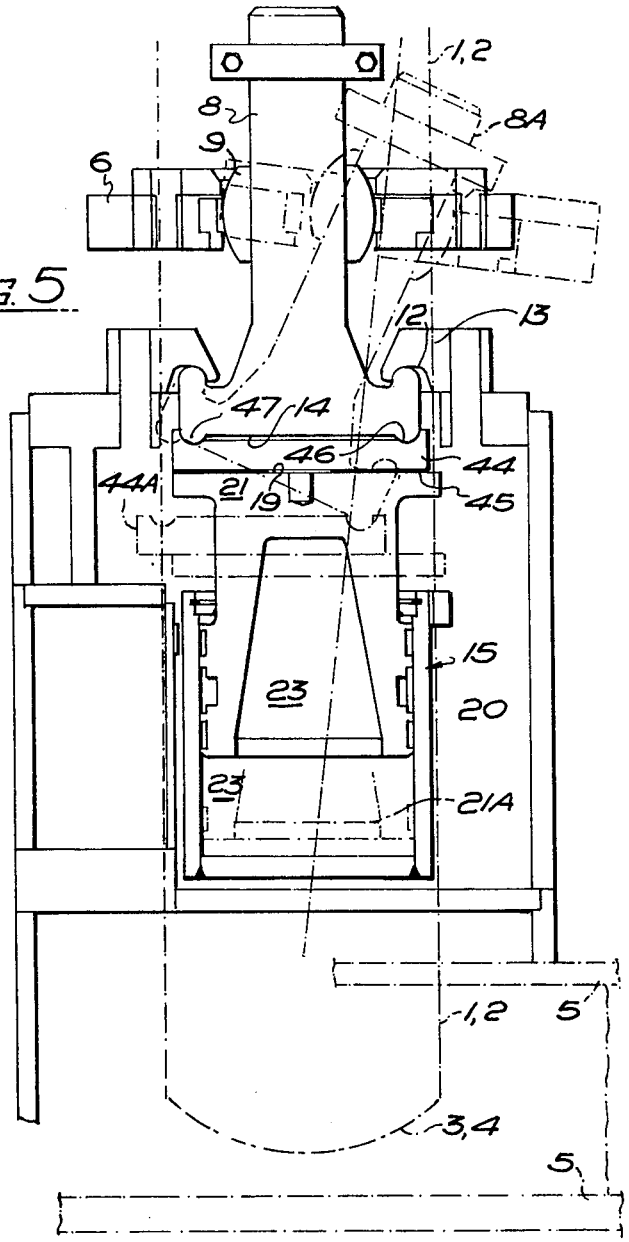
FIG. 5 shows diagrammatically a third embodiment.

In the embodiment of FIG. 5, the load applying means 15 again applies compressive forces to the pin 8, in a similar manner to the embodiment of FIG. 1, but the lateral base 10 seats on the piston 21 in contrast to the embodiment of FIG. 1. However, interposed between the lateral base 10 and the piston 21 is a slide plate 44 and a pad 45 of low friction material, the slide plate 44 being provided with an annular arcuate groove 46 to receive, in the full line position shown in FIG. 5 in which the chamber 23 is expanded fully, an annular surfaced rib 47 on the underside 14 of the lateral base 10. The slide plate 44 is displaceable with respect to the piston 21 between the position shown in full line in FIG. 5 to the position 44A shown in chain-dotted line, when the pin 8 has become inclined to the position 8A shown in chain-dotted line when the yoke 6 and the legs 1,2, etc., have become displaced the maximum permissible amount from the predetermined position, the chamber 23 then attaining its minimum volume with the piston in position 21A.

Figure 6:
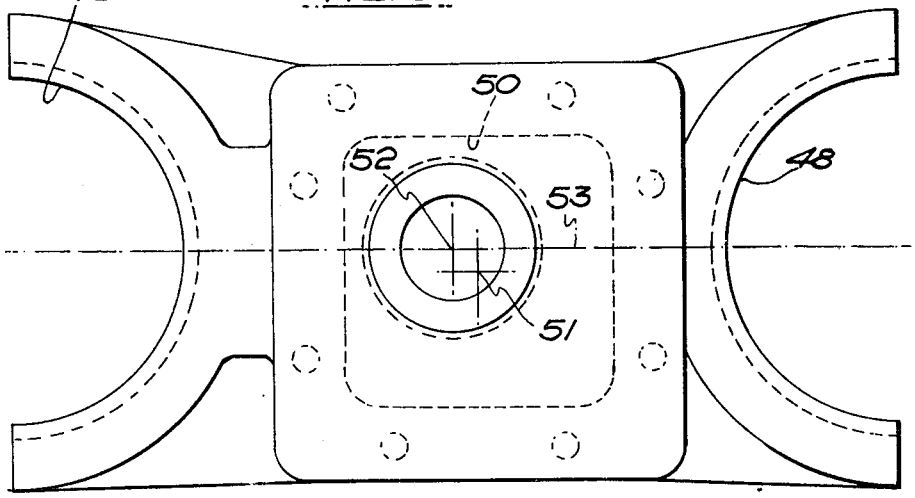
FIG. 6 and 7 show respectively a plan view and a side elevation of a yoke for use with the embodiment of FIG. 5.
Figure 7:
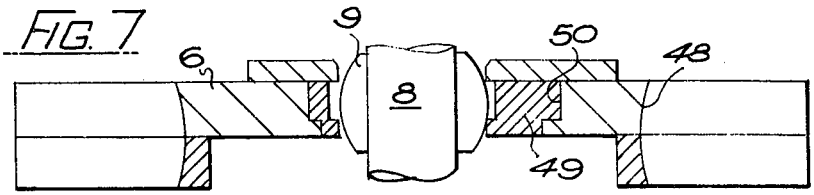

The yoke associated with the embodiment of FIG. 5 is shown in detail in FIGS. 6 and 7 and comprises a plate provided with semi-circular surfaces 48 of curvature corresponding to that of the external periphery of chock legs 1,2. The bearing 9 is mounted in a square block 49 locatable in any one of four positions in a square recess 50. Furthermore, centre 51 of the recess 50 is not coincident with centre 52 of the pin 8 which centre 52 also lies on a line 53 joining the geometrical centres of chock legs 1,2 embraced by the surface 48.

For a multi-leg roof support, the rearward pair of laterally adjacent legs are yoked together and provided with two load applying means of the form shown in FIGS. 1,2 or 5, the forward legs being displaceable by, or displacing, the rearward legs by the articulated connection of one or more roof beams. Thus, in FIG. 3 is indicated a rearward extension 6X of the yoke 6 connecting the rearward legs 1,2, if the direction of advance of the support is considered to be that of arrow A, the base member 5 being extended to 5X. Within the extension 6X are located two load applying means 15X.

What we claim is:

1. A mine roof support comprising roof beam means, base member means, and a pair of hydraulically extensible chock legs connected at upper ends thereof in articulated manner to said roof beam means and connected at lower ends thereof in articulate manner to said base member means, and rigid yoke means spaced from the base member means between and connecting together said pair of chock legs, the yoke means containing projecting pin means secured in bearing means attached to the yoke means, said pin means having lateral base means, one side of said lateral base means contained between abutment means secured to the base member means, the other side of the lateral base means secured to one end of a permanent load applying means, the other end of the permanent load applying means being supported by the base member means, said permanent load applying means permanently loading said lateral base means against said abutment means.

2. A mine roof support as claimed in claim 1 and having four chock legs, said yoke means including a first yoke connecting a pair of forward legs, and a second yoke connecting a pair of rearward legs, with the pin means being located between the respective pairs of forward and rearward legs.

3. A mine roof support as claimed in claim 1 and having at least four chock legs, said pin means including two pins in said yoke means connecting a pair of rearward legs, forces being transmitted between these legs and the other two legs via the roof beam means.

4. A mine roof support as claimed in claim 1, wherein the load applying means includes a permanently pressurised hydraulic piston and cylinder unit.

5. A mine roof as claimed in claim 1, wherein the load applying means of the pin means comprises a permanently pressurised gas unit.

6. A mine roof support as claimed in claim 5, wherein the gas is nitrogen.

7. A mine roof support as claimed in claim 1, wherein the load applying means of the pin means includes a spring.

8. A mine roof support as claimed in claim 1, wherein the load applying means of the pin means includes a rubber block.

9. A mine roof support as claimed in claim 1, wherein the pin means and lateral base means are arranged for compressive loading by the load applying means.

10. A mine roof support as claimed in claim 1, wherein the pin means and lateral base means are arranged for tensile loading by the load applying means.

11. A mine roof support as claimed in claim 9, wherein the lateral base means is seated on one piston and cylinder unit, to be urged upwardly into engagement with the abutment means, the longitudinal axes of the pin means and of the piston and cylinder unit being coincidental.

12. A mine roof support as claimed in claim 11, wherein the lateral base means is seated on the piston.

13. A mine roof support as claimed in claim 11, wherein a slide plate and a pad of low friction material are interposed between the lateral base means and the piston and cylinder unit.

14. A mine roof support as claimed in claim 10, wherein the lateral base means includes a pivot pin to which the piston of the piston and cylinder unit is attached by a flexible member, with pressurisation of the piston and cylinder unit urging the piston away from its pin, thereby tensioning a rope to pull the lateral base means into engagement with the abutment means, the longitudinal axes of the pin and the piston and cylinder unit being coincidental.

15. A mine roof support as claimed in claim 9, wherein the load applying means includes a permanently pressurised hydraulic piston and cylinder unit, and the piston and cylinder unit seats on a base plate spanning a pair of laterally spaced base members.

16. A mine roof support as claimed in claim 9, wherein the load applying means includes a permanently pressurized hydraulic piston and cylinder unit, and the lateral base means of the pin means is circular and terminates in an annular rib having arcuate bearing surfaces for contact with the abutment means and with an outer surface of the load applying means, while the abutment means include complementary, part annular recesses.

17. A mine roof support as claimed in claim 10, wherein an extension piece of the load applying means seats on the opposite side of the abutment means to which the lateral base means is pulled.

18. A mine roof support as claimed in claim 17, wherein the abutment means comprises a plate having a central aperture for passage of a flexible member.

19. A mine roof support as claimed in claim 16, wherein a shaft extends from the piston and passes through a closed end of the cylinder to project therefrom for attachment thereto of the other end of a flexible member, with an annulus side of the piston being pressurised.

20. A mine roof support as claimed in claim 1, wherein the yoke comprises a plate having spaced apart semi-circular openings of a diameter corresponding to the diameter of an external periphery of the chock legs, one opening engaging the external periphery of each chock leg.

21. A mine roof support as claimed in claim 3, wherein the yoke is provided with an extension.

22. A mine roof support as claimed in claim 4, wherein the piston and cylinder unit incorporates a spring operative in a direction of pre-loading, said spring having a rating sufficient to restore the chock legs to their initial position upon release of the support from the roof, should hydraulic failure or leakage affect the functioning of the hydraulic pre-loading.

23. A mine roof support as claimed in claim 1, wherein the position of the pin means with respect to the yoke is varied by mounting the bearing means via a multi-position block to give the effect of eccentric positioning of the bearing means and hence the pin means.

24. A mine roof support as claimed in claim 23, wherein the bearing means is mounted in a square block locatable in a square recess in the yoke and indexable between four different positions.

25. A mine roof support as claimed in claim 24, wherein the recess is off-centre with respect to the yoke.

26. A mine roof support as claimed in claim 4, wherein the unit is provided with an inlet-exhaust conduit by which hydraulic fluid is firstly admitted to the cylinder to extend the piston therefrom, the conduit being provided with a check valve and the check valve being bypassed by a relief valve comprising a poppet valve member guided for displacement along its longitudinal axis, the poppet valve member having a valve head normally urged, under the action of a compression spring, into engagement with a valve seat of a circular port, and a spindle connecting the valve head to a valve end slidable in a bore of diameter equal to that of the port, on which valve end bears the spring, through which relief valve hydraulic fluid may be exhausted from the piston and cylinder unit into the conduit.

* * * * *